US008275307B2

(12) United States Patent
Doyle, III

(10) Patent No.: US 8,275,307 B2
(45) Date of Patent: Sep. 25, 2012

(54) VEHICLE AUDIO INTEGRATOR

(75) Inventor: Marquis D. Doyle, III, Clemmons, NC (US)

(73) Assignee: QUALCOMM Incorporated, San Diego, CA (US)

( * ) Notice: Subject to any disclaimer, the term of this patent is extended or adjusted under 35 U.S.C. 154(b) by 831 days.

(21) Appl. No.: 11/492,516

(22) Filed: Jul. 24, 2006

(65) Prior Publication Data

US 2008/0032663 A1 Feb. 7, 2008

(51) Int. Cl.
*H04H 40/00* (2008.01)

(52) U.S. Cl. ..... 455/3.06; 455/3.01; 455/3.02; 455/569.1; 340/426.11; 340/426.12; 340/426.13

(58) Field of Classification Search ..... 455/556.1, 455/550.1, 569.1, 569.2, 3.01–3.06; 381/302, 381/86, 101, 102; 340/825.25; 710/36, 39–44, 710/48, 52
See application file for complete search history.

(56) References Cited

U.S. PATENT DOCUMENTS 4,941,187 A 7/1990 Slater
6,181,334 B1 * 1/2001 Freeman et al. ..... 725/138
6,778,073 B2 8/2004 Lutter et al.
2002/0098878 A1 * 7/2002 Mooney et al. ..... 455/569
2002/0196134 A1 * 12/2002 Lutter et al. ..... 340/426
2006/0046756 A1 * 3/2006 Kies ..... 455/518
2007/0127734 A1 * 6/2007 Brulle-Drews ..... 381/86

FOREIGN PATENT DOCUMENTS

EP 1494364 A1 1/2005

OTHER PUBLICATIONS

Written Opinion—PCT/US2007/074145, International Search Authority—European Patent Office—May 2, 2008.
International Search Report—PCT/US2007/074145—ISA/EPO—Jul. 22, 2008.

* cited by examiner

*Primary Examiner* — Fayyaz Alam
(74) *Attorney, Agent, or Firm* — Gerald P. Joyce, III

(57) ABSTRACT

An audio integrator monitors the outputs of a plurality of audio sources, and a controller prioritizes the audio sources. An active audio detection circuit determines when one or more of the audio sources become active. When the two or more audio sources are active simultaneously, the controller directs the highest priority audio source to one or more speakers. If a lower priority audio signal is currently playing, newly active voice communication audio, such as communications or directional information, is delayed to preserve the beginning of the message during an audio switch-over. A currently-playing, lower-priority audio signal may be decreased in volume, and a tone unique to the new audio source sounded, prior to the switching the audio to the higher-priority source. During audio input (e.g., while actuating a push-to-talk button on a microphone), all active audio sources are quieted.

44 Claims, 4 Drawing Sheets

VEHICLE AUDIO INTEGRATOR

BACKGROUND

The present invention relates generally to the field of audio control and in particular to a vehicle audio integrator.

In 2003, over 24 million trucks in the U.S. hauled over 9 billion tons of freight, logging 444.4 billion miles. Of those, over 2.6 million were class 8 trucks (weighing more than 33,000 pounds—typically, "18-wheelers"), which logged 114.1 billion miles. Accurate scheduling and real-time tracking of class 8 trucks is increasingly important to the trucking industry and its customers. For example, the "just in time" inventory model that allows factories and retailers to virtually eliminate large inventories, and accordingly, to dramatically cut operating costs, depends heavily on accurate and timely delivery of raw materials, parts, and goods, much of which are shipped by trucks.

Satellite-based vehicle communication systems have been deployed in class 8 trucks, as well as other vehicles, for years, to aid dispatchers in scheduling and tracking trucks en route. These systems provide communications between truckers and dispatchers in remote areas, where terrestrial wireless communication systems are not widely deployed, and provide at least rough estimates of the truck's geographic location. More modern vehicle communication and tracking systems include Global Positioning Satellite (GPS) receiver functionality, providing highly accurate vehicle location information. With the development and deployment of increasingly accurate geographic databases, the vehicle location systems may automatically provide real-time, turn-by-turn directions to guide drivers along predetermined routes. As well known in the art, a route comprises a plurality of predetermined waypoints, each waypoint corresponding to a specific geographic coordinate. The navigation system compares the truck's current location to the next waypoint, issuing prompts or directions as the truck approaches waypoints of interest, such as freeway exits, intersections, delivery addresses, and the like.

For safety, such turn-by-turn directions are preferably delivered audibly, such as by pre-recorded or computer-synthesized voice messages. The latter option additionally allows the system to "read" text messages, such as the Short Message Service (SMS) or "texting" offered by many cellular phone services, or e-mail, to the driver. Also, to further increase safety by minimizing diversion of the driver's attention from the task of driving the rig, these systems may now, or in the near future, include voice recognition functionality, allowing the driver to set parameters, request information, call up queued messages, and the like, via voice commands.

In creating systems that deliver information to the driver via synthesized voice and accept commands from the driver via voice recognition, designers have been forced to deal with the reality of the audio environment in a truck cab. Typically, class 8 trucks include a variety of independent audio devices, such as an in-dash AM/FM radio, tape player, CD player, or the like; a Citizens Band (CB) radio (in 2003, 28% of trucks still utilized CB radios); and personal audio sources, such as a cellular telephone equipped with a hands-free interface, MP3 music player, satellite radio receiver, and the like. Each of these audio devices has its own on-off and volume controls (as well as channel selection and other control inputs) that must be manually adjusted by the driver. Additionally, some of the audio sources have their own speakers, giving rise to widely varying audio quality, while others may access the high-fidelity speakers built into the cab through the in-dash stereo (i.e., the MP3 player may interface to the stereo through a cassette tape interface or FM modulator).

In actual use, this cluttered audio environment presents numerous problems. For example, a driver engaged in a cell phone conversation or listening to music may miss a directional instruction from the vehicle navigation system. In response, the trucker can pause the conversation or reduce the volume of the radio, and request that the directional instruction be repeated. However, a real-time message coming over the CB radio is simply lost. Furthermore, while noise-cancelling microphones and voice recognition system training can reduce or eliminate the deleterious effects of much ambient noise (such as wind, road, and engine noise), the system cannot be trained to "ignore," e.g., a voice coming in over the CB radio in the middle of a trucker's voice command. Recognition accuracy suffers so badly in the presence of multiple voices that the command will not be recognized. However, the trucker may not wish to turn off the CB radio just to give commands to the navigation system.

Some forms of simple, priority-based audio integration are known in the art, for example, those found in general aviation radios and headsets. Both intercom and radio voice communications are routed to an aviation headset, which may include an audio input for a portable satellite radio receiver, MP3 player, or the like. The system prioritizes communication channels, and switches in higher priority channels as they become active (as detected by, e.g., a squelch circuit). For example, music may be interrupted by activity on a low-priority radio channel (e.g., reporting weather or other routine information), which in turn may be interrupted by activity on a high-priority radio channel (e.g. tuned to an air traffic control frequency), which in turn may be interrupted by intercom communications. The switching between audio sources is abrupt, and the pilot may have to monitor a new audio stream for several moments to identify its source. Furthermore, the beginning of messages spoken immediately upon keying a microphone may be lost in the time required for the squelch circuit and audio switching circuit to route the new, high-priority audio to the headset speakers.

SUMMARY

According to one or more embodiments, an audio integrator monitors the outputs of a plurality of audio sources. An active audio detection circuit determines when one or more of the audio sources become active. A controller prioritizes the audio sources. When the two or more audio sources are active simultaneously, the controller directs the highest priority audio source to one or more speakers. If a lower priority audio signal is currently playing, newly active voice audio, such as communications or directional information, is delayed to preserve the beginning of the message during an audio switchover. A currently playing, lower priority audio signal may be decreased in volume, and a tone unique to the new audio source sounded, prior to the switching the audio to the higher priority source. During audio input (e.g., while actuating a push-to-talk button on a microphone), all active audio sources are quieted.

One embodiment relates to a method of managing a plurality of audio sources in a vehicle. The audio sources are prioritized. A first audio signal from a first active audio source is output to one or more speakers. A second audio source becoming active is detected, the second audio source having a higher priority than the first audio source. A second audio signal from the second audio source is delayed to prevent the loss of audible information. Output is switched from the first audio signal to the delayed second audio signal in response to detecting that the second audio source is active.

Another embodiment relates to an audio integrator connected to a plurality of audio sources. The audio integrator includes an active audio detection circuit operative to receive the output of each audio source and to output an indication of which audio sources are active. The audio integrator also includes a time delay buffer operative to selectively receive the output of one or more audio sources and to output delayed audio. The audio integrator further includes an audio multiplexer operative to receive the output of each audio source and the output of the time delay buffer and to output a single audio signal. The audio integrator additionally includes a controller operative to receive the indication of active audio sources from the active audio detection circuit, and to control the time delay buffer and the audio multiplexer.

Yet another embodiment relates to a method of switching audio output between a plurality of audio sources in a vehicle. A first audio signal from a first active audio source is output to one or more speakers. A second audio source becoming active is detected. A tone uniquely associated with the second audio source is output, and output is then switched from the first audio signal to a second audio signal from the second audio source in response to detecting that the second audio source is active.

Still another embodiment relates to a vehicle including a navigation system. The navigation system includes memory operative to store at least one predetermined waypoint, and a location estimator operative to estimate the current location of the vehicle. The navigation system also includes a controller operative to monitor the distance between the vehicle's current location and at least one predetermined waypoint. The navigation system further includes an audio generator operative to output voice prompts related to the vehicle's distance from at least one predetermined waypoint and further operative to output a signal indicative of the priority of each voice prompt. An audio integrator in the vehicle may switch between another audio source and a voice prompt from the navigation system when the priority of the voice prompt exceeds a predetermined threshold.

Still another embodiment relates to a method of managing a plurality of audio sources in a vehicle. The audio sources are prioritized such that one or more audio sources has a relatively high priority and one or more of the audio sources has a relatively low priority. The condition of two or more of the audio sources being active is detected. Which one of the active audio sources has the highest priority is determined. If the active audio source having the highest priority was initiated subsequent to any one of the other active audio sources, the active audio source with the highest priority is directed to a buffer where at least a portion of the audio associated therewith is stored.

DETAILED DESCRIPTION

As vehicle location tracking and communication systems increase in functionality and complexity, generate synthesized voice messages, and employ speech recognition to accept spoken command inputs, it is clear that safe and effective use of the system requires integration of the entire truck cab audio environment. Accordingly, in one or more embodiments the present invention relates to a priority-based audio integrator that controls the routing of audio signals from a plurality of audio sources to one or more speakers. In particular, audio from a newly active high-priority audio source may interrupt currently-playing audio from a low-priority audio source in an elegant manner, and with a unique audible indicator, to efficiently deliver audio from competing sources to the driver of a vehicle in a way that maximizes the driver's ability to comprehend and interpret all audio. Voice communication audio may be buffered during the switch-over, to avoid the loss of audible information. Although the present invention is described herein in the context of a truck cab, it is not limited to this application, and may be advantageously applied to control audio sources in any vehicle.

Figure 1:
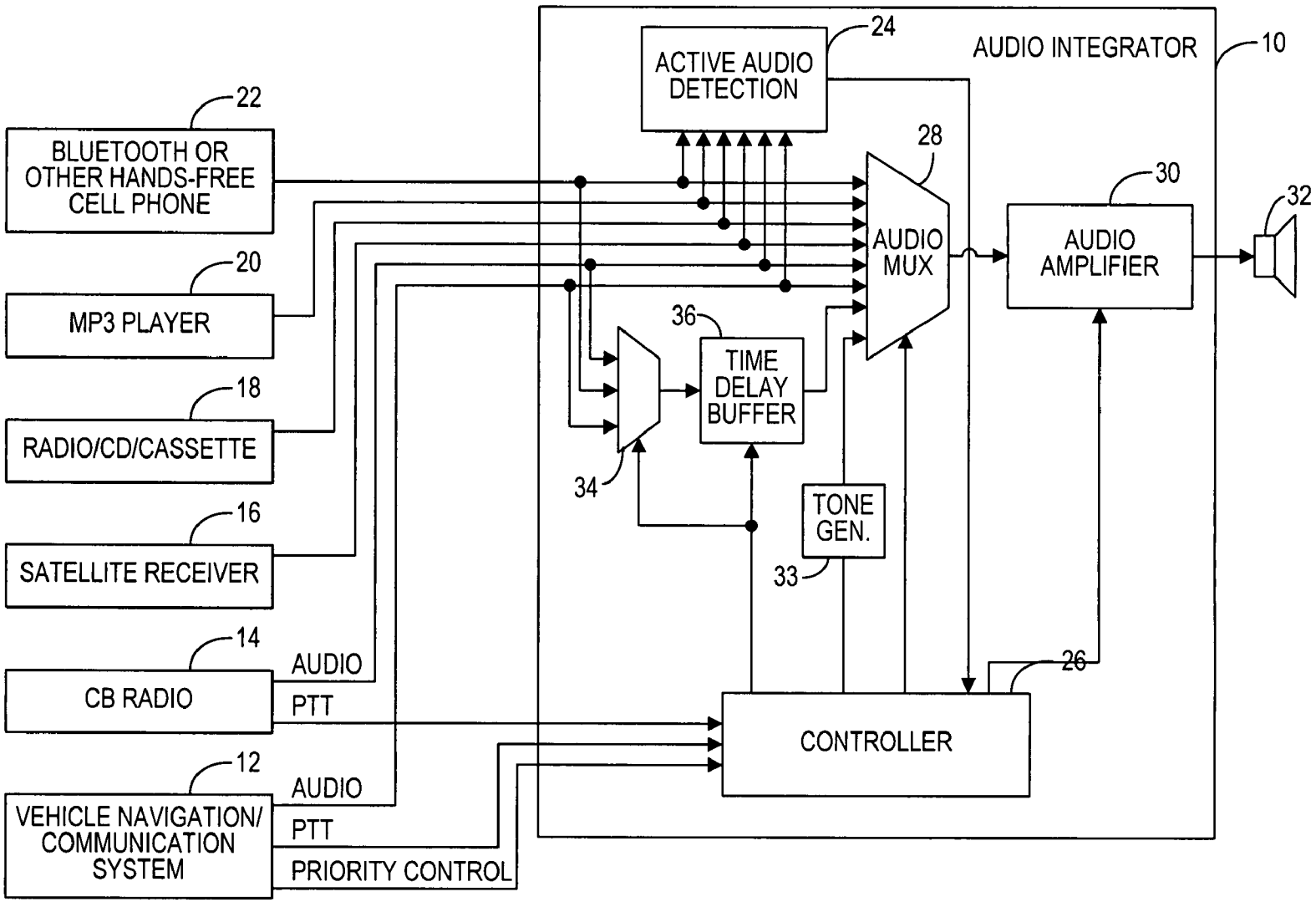
FIG. 1 is a functional block diagram of an audio integrator.

FIG. 1 depicts an audio integrator 10. The audio integrator 10 integrates audio from a plurality of connected audio sources, such as a vehicle navigation system 12, CB radio 14, satellite radio receiver 16, in-dash entertainment console 18, portable MP3 player 20, hands-free cell phone interface (e.g., Bluetooth interface) 22, and the like, and outputs an audio signal to one or more speakers 32. The depicted audio sources 12-22 are neither exclusive nor exhaustive. The audio integrator 10 comprises an active audio detection circuit 24, controller 26, audio multiplexer 28, audio amplifier 30, time delay buffer input selector 34, and time delay buffer 36.

The audio output of each audio source 12-22 is provided as an input to an active audio detection circuit 24. The active audio detection circuit 24 determines which of the audio sources 12-22 are active. In one embodiment, the active audio detection circuit 24 monitors each audio signal, and outputs an indication of active audio when the signal energy exceeds a predetermined threshold. In another embodiment, an audio source 12-22 may provide both an audio signal and an audio active signal (e.g., a sideband signal) to the active audio detection circuit 24. In still another embodiment, an audio source 12-22 may output digital audio, or a combination of digital and analog audio, with the audio active condition being indicated by digital content (e.g., the data in control channels, packet headers, or the like). Those of skill in the art will recognize that the active audio detection circuit 24 may include any combination of the above active audio detection techniques.

The active audio detection circuit 24 sends an indication of which audio sources 12-22 are active to a controller 26. The controller 26 may comprise a general-purpose microprocessor, microcontroller, Digital Signal Processor (DSP), or other processor, with its functionality defined by software, as known in the art. Alternatively, the controller 26 may comprise a dedicated state machine or other hard-wired, special-purpose circuit. In either case, the controller 26 may be implemented as a stand-alone integrated circuit, ASIC, FPGA, or the like, or may comprise a processing core implemented along with other circuit elements in an ASIC or full-custom integrated circuit.

The controller 26 prioritizes the audio sources 12-22, and monitors the indication from the active audio detection circuit 24 of which of the audio sources 12-22 are currently active. In one embodiment, communication-related audio sources, such as the CB radio 14 and cell phone interface 22, are assigned a higher priority than entertainment-related audio sources, such as radio receivers 16, 18, MP3 player 20, or the like. In one embodiment, information-related audio sources, such as the vehicle navigation/communication system 12, are additionally assigned a higher priority than the entertainment-related audio sources 16, 18, 20. In one embodiment, the relative priority between communication and information audio sources may be selected by the user. All of the relative priorities of audio sources 12-22 are preferably configurable, such as by software. In one embodiment, the priority of audio sources 12-22 is determined by which audio input jack of the audio integrator 10 each audio source 12-20 is plugged into.

In one embodiment, the priority of one or more audio sources 12-22 may change dynamically. For example, a vehicle navigation/communication system 12 may issue pre-recorded or synthesized voice prompts, or turn-by-turn directions, to direct the driver along a predetermined course. A preliminary warning (e.g., "exit 1 mile ahead") may have a relatively low priority, and may not interrupt, for example, incoming audio from the CB radio 14. As the vehicle navigation system tracks the progress of the vehicle, an updated warning (e.g., "exit 500 feet ahead") may have a much higher priority, and would interrupt CB radio 14 audio output. As another example, a message received by the vehicle navigation/communication system 12 may be flagged as a high-priority message, and the controller 26 may assign a corresponding high priority to a synthesized voice audio rendition of the message.

An audio multiplexer 28 receives the audio output of each audio source 12-22 and, in response to the controller 26, passes audio from one of the audio sources 12-22 to an audio amplifier 30. The audio amplifier 30 adjusts the amplitude of the audio signal it received from the audio multiplexer 28 in response to the controller 26 via, e.g., an adjustable preamp, a gain control circuit, or the like. The amplified audio output of the audio amplifier 30 is received by one or more speakers 32, which transduce the audio signal into audible sound, as well known in the art.

The controller 26 operates to interrupt a currently-playing audio source 12-22 wherein a higher-priority audio source 12-22 becomes active. For example, audio from a radio 18 or MP3 player 20 may be interrupted when audio from a communication audio source such as a CB radio 14 or navigation system 12 becomes active. When the communication audio source again becomes inactive (i.e., the message has been received), the controller 26 will return to playing the previously-active audio source 12-22, if no intervening, a higher-priority audio source 12-22 has become active. That is, upon the highest-priority (and hence, the currently-playing) audio source 12-22 becoming inactive, the next-highest-priority active audio source 12-22 will be played. If two or more active audio sources 12-22 have been assigned the same priority, the one that was previously interrupted by a higher-priority audio source 12-22 will be selected when the higher-priority audio (and any intervening higher-priority audio) goes inactive.

In one embodiment, when switching between audio sources 12-22—for example, when switching from a CD player 18 to a satellite radio receiver 16—the controller 26 gradually decreases or "ramps down" the volume level of the currently-playing CD player 18, by sending appropriate control signals to the audio amplifier 30 to decrease the output audio amplitude, prior to directing the audio multiplexer 28 to route the selected satellite radio receiver 16 to the audio amplifier 30. This feature is particularly useful in the case where a higher priority audio source becomes active—such as a communication being received on the CB radio 14. A sudden or immediate transition of audio from music to a CB message may startle the driver. In contrast, ramping down the volume of the currently-playing, lower-priority audio source alerts the driver that a higher-priority audio is upcoming.

In one embodiment, when switching from a first audio source to a second audio source, the controller 26 directs a tone generator unit 33 to generate unique audible indicator, such as a tone or chime. The controller 26 routes the unique audible indicator to the speakers 32, prior to routing audio from the second audio source to the speakers 32. A separate audible indicator is uniquely associated with each audio source 12-22, and playing the audible indicator serves as a "flag" or indication to the user of which audio source 12-22 is about to be played. This is particularly useful in the case of a higher-priority audio source that becomes active, interrupting a lower-priority audio source that is currently playing, as described above. By playing a tone uniquely associated with the higher-priority audio source, the driver is alerted as to the nature of the upcoming audio (e.g. conversation from a CB radio 14, or turn directions from the vehicle navigation system 12). Research indicates that drivers are better able to interpret voice audio when they anticipate its nature.

Some of the audio sources 12-22 generate high-priority, voice communication audio, such as the CB radio 14 or hands-free cell phone interface 22 (as opposed to, e.g., voice on a radio station or book-on-tape). Another source of high-priority, voice communication audio may be pre-recorded or synthesized voice audio from the vehicle navigation/communication system 12. For example, the navigation system may issue turn-by-turn directions, or the communication system may "read" e-mail or other messages to the driver. If any of these high-priority audio sources become active when a lower-priority audio signal is being routed to the speakers 32, the beginning of the voice communication message may be lost during the time required for the audio multiplexer 28 to switch to the new audio source. This is particularly true when the currently-playing audio is faded out prior to the switch, and when a unique tone identifies the upcoming voice communication audio source.

In one embodiment, the audio integrator 10 includes an input selector 34 and a time delay buffer 36. The input selector 34 selects one of a plurality of high-priority, voice communication audio sources 12, 14, 22 in response to the controller 26, and outputs the selected voice communication audio to the time delay buffer 36. The time delay buffer 36 delays the voice communication audio by at least an amount sufficient to allow a currently-playing, low-priority audio signal to be faded out and a unique, audible identifier to be sounded, prior to routing the output of the time delay buffer 36 to the speakers 32 via the audio multiplexer 28.

Figure 2:
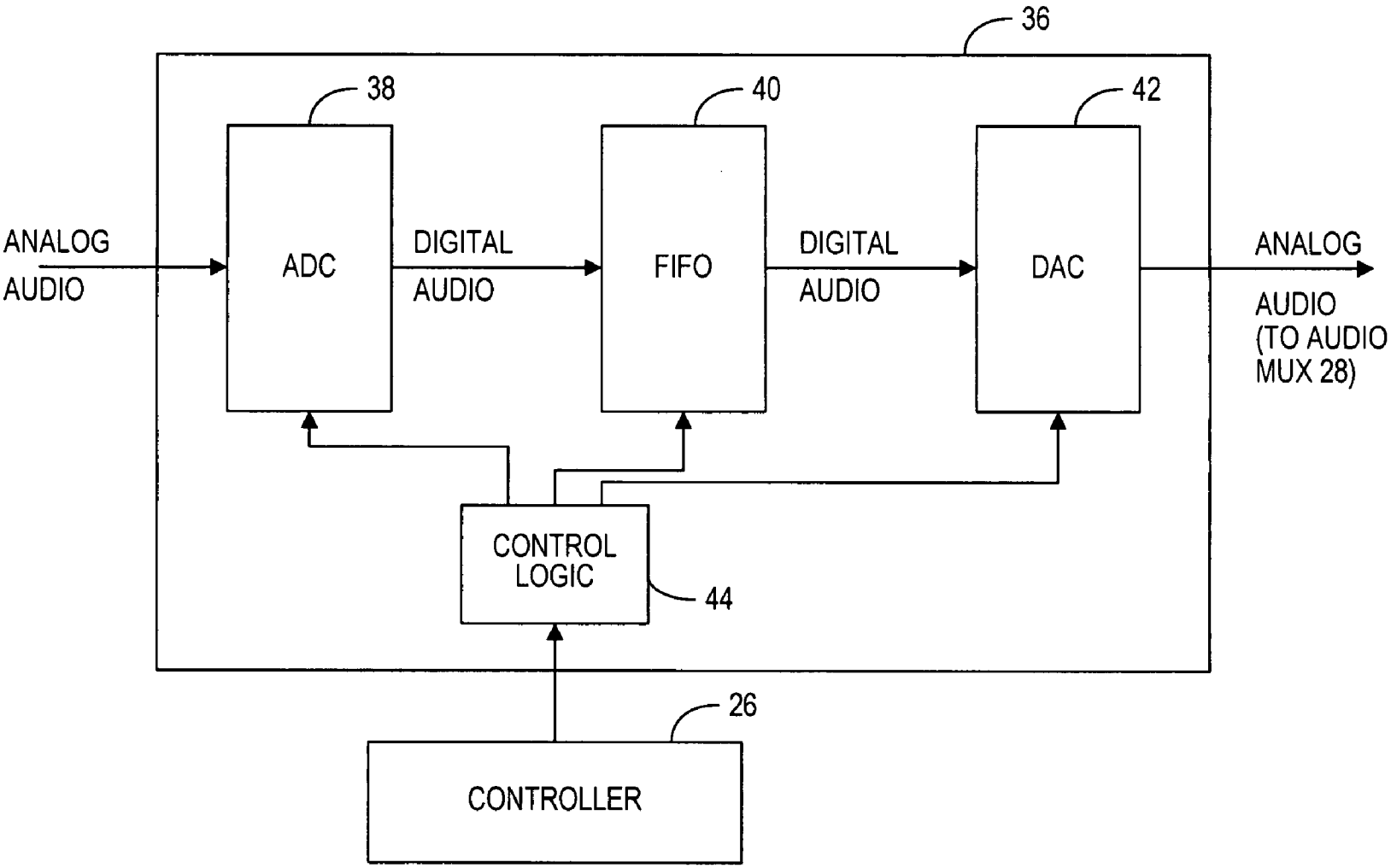
FIG. 2 is a functional block diagram of a time delay buffer circuit.

FIG. 2 depicts a functional block diagram of one embodiment of a time delay buffer 36. The time delay buffer 36 comprises an Analog to Digital Converter (ADC) 38, a digital buffer 40, and a Digital to Analog Converter (DAC) 42. The ADC 38 converts an analog audio input to digital form. The digital audio is stored in a buffer 40, which may for example comprise a First-In, First-Out (FIFO) buffer. After the required time delay, the digital audio is read from the buffer 40 and converted to analog form by the DAC 42. The analog audio signal is then routed from the time delay buffer 36 to the audio multiplexer 28, where it may be selected by the controller 26 and routed through the audio amplifier 30 to the speakers 32 (see FIG. 1). In one embodiment, the time delay buffer 36 includes a control circuit 44 that manages the ADC 38 and DAC 42, and generates the read and write control signals required to implement the buffer 40, all under the control of the controller 26. In another embodiment, the controller 26 may directly generate all necessary control signals. In another embodiment, the time delay functionality may be performed via software executing, e.g., in the controller 26

The actual implementation of a time delay buffer 36 may be optimized for any particular application by those of skill in the art.

In most cases, the time delay buffer 36 is only required to delay voice communication audio by a few seconds—time to ramp down currently-playing audio and sound an audible indicator associated with the delayed voice communication audio. However, in some circumstances, more delay may be required. For example, a relatively low priority navigation prompt may be buffered during a CB radio 14 message. In this case, the time delay buffer 36 must store the longest anticipated navigation prompt, which may comprise, e.g., five to seven seconds of voice communication audio. The depth of the time delay buffer 36 may be optimized for any particular application by those of skill in the art.

Although not depicted in FIG. 1, two or more time delay buffers 36 may be provided (each with a corresponding input selector 34). This may allow the audio integrator 10 to delay two or more voice communication audio signals. For example, synthesized voice turn directions from a navigation system 12 may interrupt music, requiring the voice communication signal to be time-delayed while the music volume ramps down and an audible identifier unique to the navigation system 12 is sounded. If the audio from a CB radio 14 goes active at the same time or immediately thereafter, the CB radio voice communication signal may be time-delayed in a second time delay buffer 36, until the turn directions have been delivered, and an audible identifier unique to the CB radio 14 is sounded. Those of skill in the art may determine the appropriate number of time delay buffers 36, and the depth or time-delay capacity of each time delay buffer 36, for a particular application.

In one or more embodiments, the audio integrator 10 additionally controls the truck cab audio environment during audio input conditions. In particular, the controller 26 quiets all audio output from the speakers 32 by directing the audio amplifier 32 cut off audio output for the duration of any audio input condition. An audio input condition may be detected by monitoring the Push-To-Talk (PTT) button of, e.g., the CB radio 14 microphone. Additionally, as the vehicle navigation/communication system 10 evolves, it may employ voice recognition capability to accept audible commands from the driver. Accordingly, the vehicle navigation/communication system 12 may include a dedicated microphone with a PTT switch. Alternatively, an integrated system may provide a single microphone with separate PTT switches is for the CB radio 14 and vehicle navigation/communication system 12 functionality. In either case, the actuation of a PTT button indicates an audio input condition, during which the controller 26 will quiet all audio output from the speakers 32. This is necessary to allow clear communication on the CB radio 14, and to maximize the voice recognition effectiveness of the vehicle navigation/communication system 12.

Figure 3:
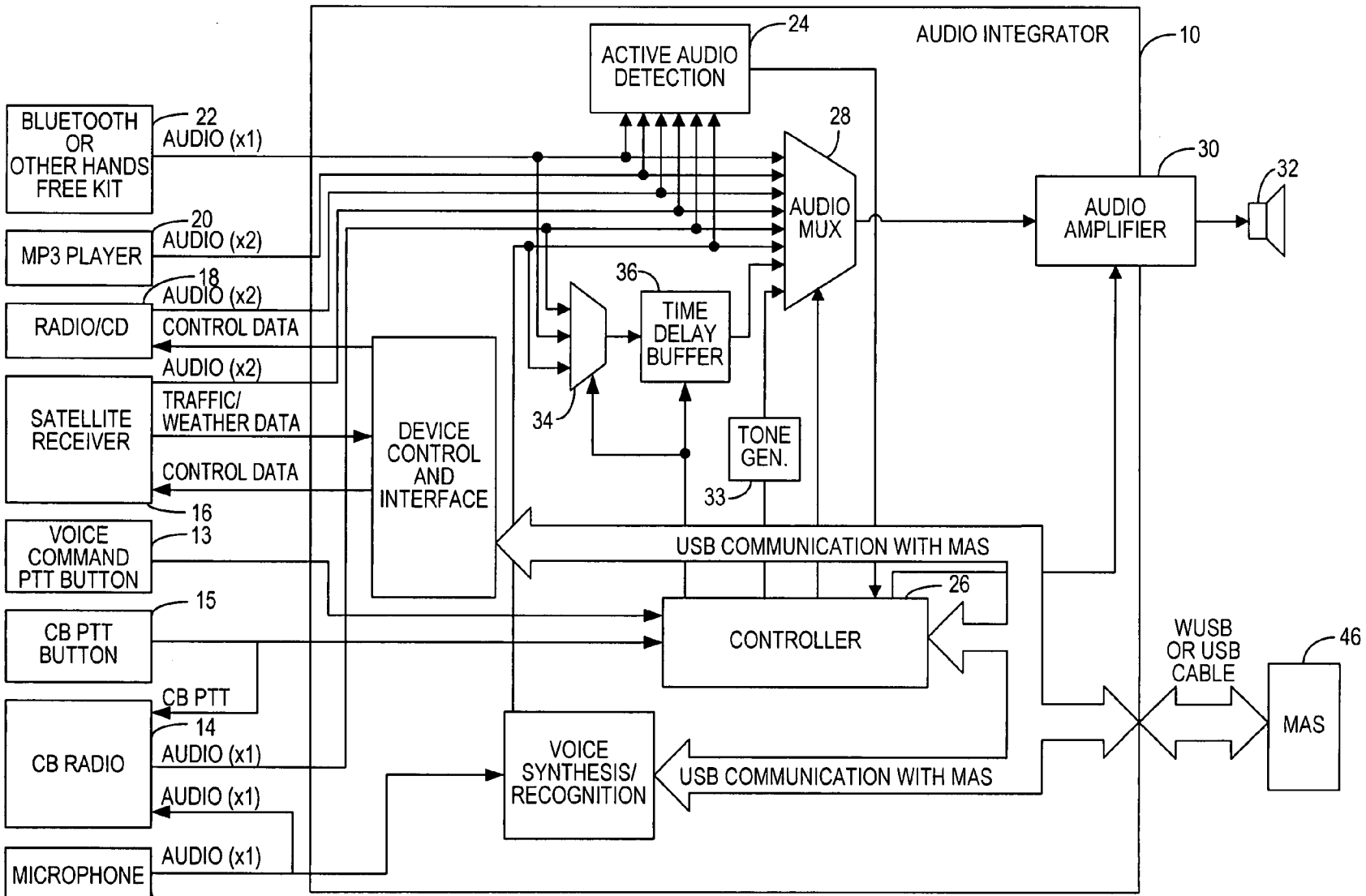
FIG. 3 is a functional block diagram of a highly integrated audio integrator.

FIG. 3 depicts a functional block diagram of a more integrated audio integrator 10, according to one embodiment. A Mobile Application Server (MAS) 46 integrates the functionality of the vehicle navigation/communication system 12 depicted in FIG. 1, and may integrate additional functionality such as conversation logging, vocal memo recording, device control, and the like. The MAS 46 communicates with various components of the audio integrator 10 via an industry standard digital bus, such as for example the Universal Serial Bus (USB).

The audio integrator 10 according to this embodiment connects to the same audio sources 14, 16, 18, 20, 22 and truck cab speaker 32 as the audio integrator of the embodiment depicted in FIG. 1. In this embodiment, a common microphone 11 provides audio input for both the CB radio 14 and the MAS 46 (via the voice recognition functionality of the voice unit 48). The microphone 11 includes a voice command PTT button 13 and a CB PTT button 15. Internally, the audio integrator 10 includes the same functional units as the embodiment of FIG. 1, such as the active audio detector 24, controller 26, audio multiplexer 28, audio amplifier 30, tone generator unit 33, time delay buffer input selector 34, and time delay buffer 36. These units function in the same manner as previously described.

The audio integrator 10 according to this embodiment additionally includes a voice unit 48 that generates a synthesized voice communication audio from the MAS, and recognizes driver commands to the MAS during an audio input condition signified by actuation of the voice command PTT button 13. In addition to synthesizing voice communication audio, the voice unit 48 may additionally generate the unique audible indicators such as chimes, tones, and the like, in lieu of the tone generator unit 33.

The audio integrator 10 according to this embodiment also includes a device control and interface unit 50. In response to the MAS 46, the device unit 50 generates control signals (e.g., channel selection and the like) to control audio devices such as the radio receiver 18 or satellite radio receiver 16. In addition, the device unit 50 may receive traffic and weather data from the satellite radio receiver 16, forwarding this data to the MAS 46 for use by its route planning functionality.

Further integration is anticipated, and is within the scope of the present invention. For example, one or more of the audio sources 14-22, 46 may be fully integrated into the audio integrator 10. In particular, entertainment, communication, and information audio sources 14-22, 46; the audio integrator 10 functionality of controlling the truck cab audio environment; and video displays such as navigation system moving-map displays, back-up and blind-spot camera video display, and entertainment video display such as movies or games (interlocked to the ignition); may be fully integrated into a single, in-dash unit.

Figure 4:
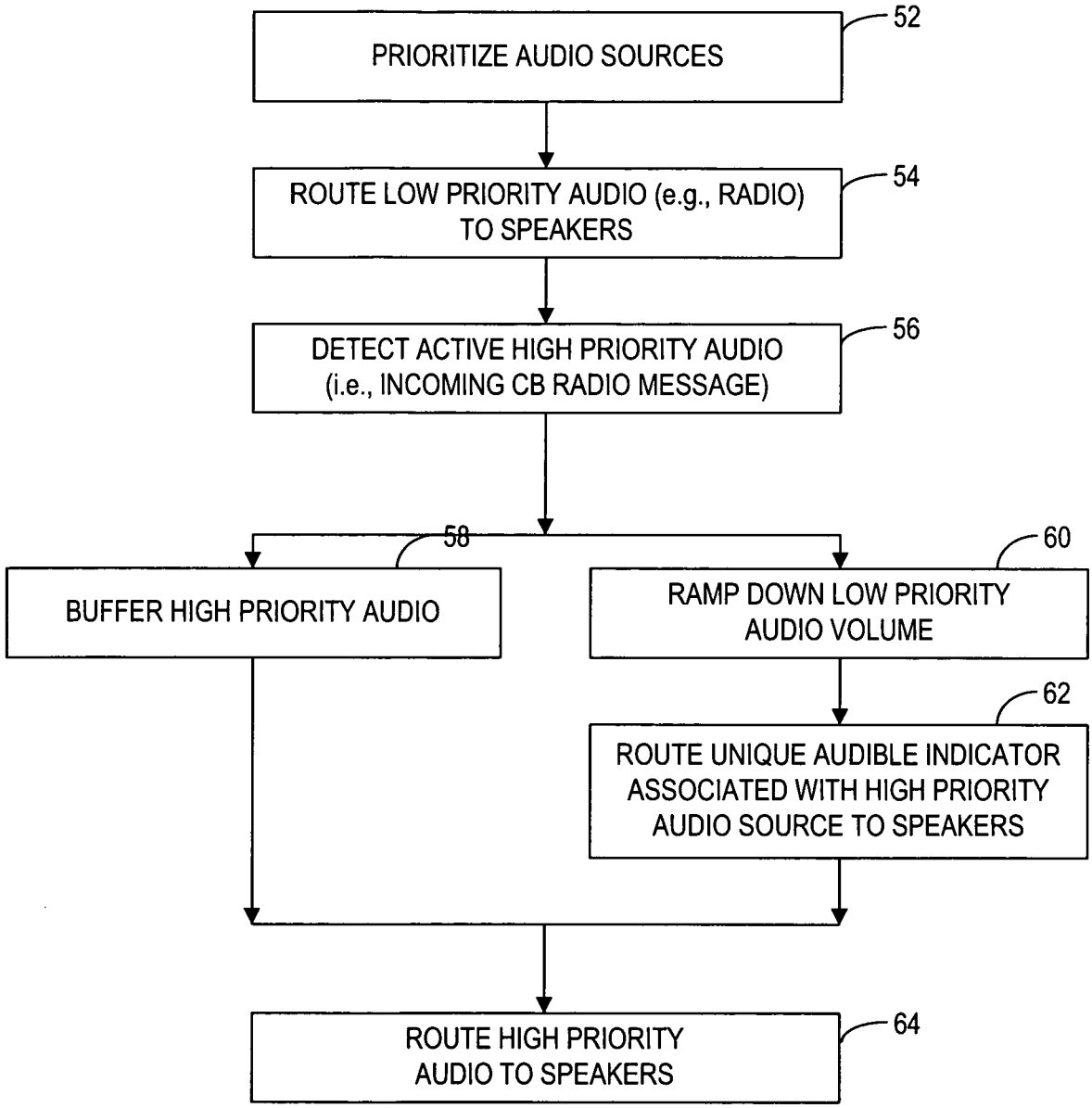
FIG. 4 is a flow diagram of a method of controlling a vehicle audio environment.

FIG. 4 depicts a method of controlling the audio environment of a truck cab, in flow diagram form. A plurality of audio sources is prioritized (block 52). This may occur as a result of the order in which audio sources are connected to the audio integrator 10, may be predetermined such as by setting switches or in software, or may be dynamically determined for one or more audio sources. Low priority audio, such as the output of a radio 18 or MP3 player 20, is routed to the speakers 32. This may occur as a result of an explicit user selection, or the audio integrator 10 may default to a particular entertainment audio source 16, 18, 20 in the absence of any active, higher-priority communication or information audio source 12, 14, 22, 46.

When the active audio detector circuit 22 detects an active output of a high-priority audio source 12, 14, 22, 46 (block 56), it sends an indication of such to the controller 26. The controller 26 then routes audio from the active, high-priority audio source 12, 14, 22, 46 to the time delay buffer 36 via control of the time delay buffer input selector 34, and controls the time delay buffer 36 to buffer the high priority audio (block 58). Simultaneously, the controller 26 ramps down the correctly-playing, low priority audio volume by controlling the audio amplifier 30 to reduce the amplitude of its audio output (block 60). The controller 26 then routes a unique audible indicator associated with the high-priority audio source from the tone generator unit 33 to the speakers 32 (block 62). The controller 36 then routes the buffered high-priority audio from the time delay buffer 36 to the speakers 32 (block 64).

In this manner, the driver does not miss any of the high-priority audio, due to the time delay buffering. The driver is mentally alerted to the fact of an incoming high-priority audio message by the ramp-down in volume of the currently-playing audio. The driver is further mentally alerted to the nature of the upcoming high-priority audio message by the unique audible indicator. Research has shown that the drivers receive and comprehend disparate audio messages more effectively when they are presented in an orderly, identified fashioned, as opposed to the cacophony of independent, autonomous audio sources.

Although various embodiments of the present invention has been described herein with respect to the cab of a class 8 truck, the present invention is not limited to this application. As those of skill in the art will readily recognize, the teachings of the present disclosure may be advantageously applied to control the audio environment of any vehicle, such as an automobile, aircraft, or the like. Furthermore, although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A method of managing a plurality of audio sources in a vehicle, comprising:

dynamically prioritizing the audio sources;

outputting a first audio signal from a first active audio source to one or more speakers;

detecting that a second audio source has become active, the second audio source having a higher priority than the first audio source;

delaying a second audio signal from the second audio source to prevent the loss of audible information;

directing a tone to the speakers prior to switching from the first audio signal to the second audio signal wherein the tone is uniquely associated with the second audio source and indicates that a switch from the first audio source to the second audio source is occurring; and switching from the first audio signal to the delayed second audio signal in response to detecting that the second audio source is active.

2. The method of claim 1 wherein dynamically prioritizing the audio sources comprises assigning communication and information audio sources a higher priority than entertainment audio sources.

3. The method of claim 1 wherein detecting that a second audio source has become active comprises monitoring the output of each of the plurality of audio sources in an active audio detection circuit.

4. The method of claim 1 wherein routing switching between audio signals comprises routing audio signals from each of the plurality of audio sources to an audio multiplexing circuit, and controlling the select inputs to the audio multiplexing circuit.

5. The method of claim that 1 further comprising decreasing the volume of the first audio signal prior to switching to the second audio signal.

6. The method of claim 1 wherein delaying a second audio signal comprises routing the second audio signal through a time delay buffer circuit.

7. The method of claim 1 wherein delaying a second audio signal comprises digitizing the second audio signal, buffering the digital audio, and converting the buffered digital audio to a delayed analog audio signal.

8. The method of claim 7 wherein buffering the digital audio comprises writing the digital audio to a First-In, First-Out (FIFO) buffer, and reading the digital audio from the FIFO buffer after a time delay.

9. The method of claim 1 wherein delaying a second audio signal occurs only for voice communication signals.

10. The method of claim 9 wherein delaying a second audio signal occurs only for voice communication audio signals that become active when another active audio source is being output to the speakers.

11. The method of claim 1 further comprising:

detecting an audio input condition; and halting audio output from all audio sources for the duration of the audio input condition.

12. The method of claim 11 wherein detecting an audio input condition comprises detecting the actuation of a Push-To-Talk (PTT) switch.

13. An audio integrator connected to a plurality of audio sources, comprising:

an active audio detection circuit configured to receive an output of each audio source and to output an indication of which audio sources are active;

a time delay buffer configured to selectively receive the output of one or more audio sources and to output delayed audio;

a tone generator configured to output a unique tone associated with each audio source;

an audio multiplexer configured to receive the output of each audio source, the output of the time delay buffer, and the output of the tone generator, and further configured to output a uniquely associated tone prior to switching to an output of a single audio signal to indicate that a switch between audio sources is occurring; and a controller configured to receive the indication of active audio sources from the active audio detection circuit, and dynamically prioritize the active audio sources, and to control the time delay buffer and the audio multiplexer to switch from a first audio signal from a first audio source to a delayed second audio signal from a second audio source, after playing the tone uniquely associated with the second audio source, in response to determining that the second audio source has a higher priority than the first audio source.

14. The audio integrator of claim 13, further comprising one or more speakers configured to receive the audio signal from the audio multiplexer.

15. The audio integrator of claim 14, further comprising an audio amplifier interposed between the audio multiplexer and one or more of the speakers and configured to control the volume of an audio signal sent to the speakers, under the control of the controller.

16. The audio integrator of claim 13 wherein the time delay buffer comprises:

an analog to digital converter configured to digitize audio input;

a buffer configured to temporarily store digital audio; and a digital to analog converter configured to convert buffered digital audio to analog format and output the delayed analog audio.

17. The audio integrator of claim 16 wherein the buffer is a First-In, First-Out (FIFO) buffer.

18. The audio integrator of claim 13 wherein the controller is further configured to receive one or more indications of an audio input condition.

19. The audio integrator of claim 18 wherein at least one indication of an audio input condition a Push-To-Talk (PTT) switch.

20. The audio integrator of claim 13 wherein the controller is further configured to quiet audio from all audio sources for the duration of any audio input condition.

21. A method of switching audio output between a plurality of audio sources in a vehicle, comprising:

dynamically prioritizing the audio sources;

outputting a first audio signal from a first active audio source to one or more speakers;

detecting that a second audio source has become active;

outputting a tone uniquely associated with the second audio source indicating that a switch from the first audio source to the second audio source is occurring;

delaying a second audio signal from the second audio source to prevent the loss of audible information; and switching from the first audio signal to the second delayed audio signal in response to detecting that the second audio source is active.

22. The method of claim 21 wherein the second audio source has a higher priority than the first audio source.

23. The method of claim 21 further comprising decreasing the volume of the first audio signal prior to outputting the tone uniquely associated with the second audio source.

24. The method of claim 21 further comprising time-delay buffering the second audio signal, for at least the duration of the tone, prior to switching audio signals, to avoid loss of audible information in the second audio signal.

25. A computer product comprising:

A non-transitory computer readable medium comprising:

instructions for dynamically prioritizing the audio sources;

instructions for outputting a first audio signal from a first active audio source to one or more speakers;

instructions for detecting that a second audio source has become active, the second audio source having a higher priority than the first audio source;

instructions for delaying a second audio signal from the second audio source to prevent the loss of audible information;

instructions for directing a tone to the speakers prior to switching from the first audio signal to the second audio signal wherein the tone is uniquely associated with the second audio source and indicates that a switch from the first audio source to the second audio source is occurring; and instructions for switching from the first audio signal to the delayed second audio signal in response to detecting that the second audio source is active.

26. The computer product of claim 25 wherein the instructions for dynamically prioritizing the audio sources comprises instructions for assigning communication and information audio sources a higher priority than entertainment audio sources.

27. The computer product of claim 25 wherein the instructions for detecting that a second audio source has become active comprises instructions for monitoring the output of each of the plurality of audio sources in an active audio detection circuit.

28. The computer product of claim 25 wherein the instructions for switching between audio signals comprises instructions for routing audio signals from each of the plurality of audio sources to an audio multiplexing circuit, and instructions for controlling the select inputs to the audio multiplexing circuit.

29. The computer product of claim 25 further comprising instructions for decreasing the volume of the first audio signal prior to switching to the second audio signal.

30. The computer product of claim 25 wherein the instructions for delaying a second audio signal comprises instructions for routing the second audio signal through a time delay buffer circuit.

31. The computer product of claim 25 wherein the instructions for delaying a second audio signal comprises instructions for digitizing the second audio signal, buffering the digital audio, and instructions for converting the buffered digital audio to a delayed analog audio signal.

32. The computer product of claim 31 wherein the instructions for buffering the digital audio comprises instructions for writing the digital audio to a First-In, First-Out (FIFO) buffer, and instructions for reading the digital audio from the FIFO buffer after a time delay.

33. The computer product of claim 25 wherein the instructions for delaying a second audio signal are only executed for voice communication signals.

34. The computer product of claim 25 wherein instructions for delaying a second audio signal occurs are only executed for voice communication audio signals that become active when another active audio source is being output to the speakers.

35. The computer product of claim 25 further comprising:

instructions for detecting an audio input condition; and instructions for halting audio output from all audio sources for the duration of the audio input condition.

36. The computer product of claim 35 wherein the instructions for detecting an audio input condition comprises instructions for detecting the actuation of a Push-To-Talk (PTT) switch.

37. An audio integrator connected to a plurality of audio sources, comprising:

active audio detection means for receiving an output of each audio source and outputting an indication of which audio sources are active;

time delay buffer means for selectively receiving the output of one or more audio sources and outputting delayed audio;

tone generator means for outputting a unique tone associated with each audio source;

audio multiplexer means for receiving the output of each audio source, the output of the time delay buffer, and the output of the tone generator, and outputting a uniquely associated tone prior to switching to an output of a single audio signal to indicate that a switch between audio sources is occurring; and controller means for receiving the indication of active audio sources from the active audio detection circuit, dynamically prioritizing the active audio sources, and controlling the time delay buffer and the audio multiplexer to switch from a first audio signal from a first audio source to a delayed second audio signal from a second audio source, after playing the tone uniquely associated with the second audio source, in response to determining that the second audio source has a higher priority than the first audio source.

38. The audio integrator of claim 30, further comprising a speaker configured to receive the audio signal from the audio multiplexer.

39. The audio integrator of claim 38, further comprising audio amplifier means interposed between the audio multiplexer means and the speaker, the audio amplifier means for controlling the volume of an audio signal sent to the speakers.

40. The audio integrator of claim 30 wherein the time delay buffer means comprises:

analog to digital converter means for digitizing audio input;

buffer means for temporarily storing digital audio; and digital to analog converter means for converting buffered digital audio to analog format and output the delayed analog audio.

41. The audio integrator of claim 40 wherein the buffer means comprises a First-In, First-Out (FIFO) buffer.

42. The audio integrator of claim 37 wherein the controller means receives one or more indications of an audio input condition.

43. The audio integrator of claim 34 wherein at least one indication of an audio input condition is a Push-To-Talk (PTT) switch.

44. The audio integrator of claim 37 wherein the controller means quiets audio from all audio sources for the duration of any audio input condition.

* * * * *